US009079209B2

(12) United States Patent
Kim et al.

(10) Patent No.: US 9,079,209 B2
(45) Date of Patent: Jul. 14, 2015

(54) APPARATUS FOR POWER COATING

(76) Inventors: Ok Ryul Kim, Gyeonggi-do (KR); Ok Min Kim, Gyeonggi-do (KR); Kuen Sik Lee, Gyeonggi-do (KR); Seung Chae Cheong, Incheon (KR)

( * ) Notice: Subject to any disclaimer, the term of this patent is extended or adjusted under 35 U.S.C. 154(b) by 53 days.

(21) Appl. No.: 13/878,163

(22) PCT Filed: Oct. 8, 2010

(86) PCT No.: PCT/KR2010/006889

§ 371 (c)(1),
(2), (4) Date: Apr. 5, 2013

(87) PCT Pub. No.: WO2012/046898

PCT Pub. Date: Apr. 12, 2012

(65) Prior Publication Data

US 2013/0192519 A1 Aug. 1, 2013

(51) Int. Cl.

| | |
|---|---|
| ***B05C 19/04*** | (2006.01) |
| ***B05B 5/03*** | (2006.01) |
| ***B05B 7/14*** | (2006.01) |
| ***B05B 5/00*** | (2006.01) |
| ***C23C 24/04*** | (2006.01) |

(52) U.S. Cl.
CPC . *B05C 19/04* (2013.01); *B05B 5/00* (2013.01); *B05B 5/032* (2013.01); *B05B 7/1486* (2013.01); *C23C 24/04* (2013.01)

(58) Field of Classification Search
CPC ..... B05C 19/04; B05B 5/00; B05B 5/032; B05B 7/1486; C23C 24/04
USPC ..... 118/50, 50.1, 308, 610, 620, 629, 708, 118/715; 239/690, 693, 708
See application file for complete search history.

(56) References Cited

U.S. PATENT DOCUMENTS

| | | | | |
|---|---|---|---|---|
| 3,735,792 | A * | 5/1973 | Asizawa et al. | 159/4.04 |
| 4,815,414 | A * | 3/1989 | Duffy et al. | 118/308 |
| 5,209,821 | A * | 5/1993 | Shaw et al. | 159/4.01 |
| 5,302,414 | A * | 4/1994 | Alkhimov et al. | 427/192 |
| 6,139,913 | A * | 10/2000 | Van Steenkiste et al. | 427/191 |
| 6,569,245 | B2 * | 5/2003 | Krysa et al. | 118/308 |
| 6,759,085 | B2 * | 7/2004 | Muehlberger | 427/189 |
| 7,306,503 | B2 * | 12/2007 | Saito et al. | 445/50 |

FOREIGN PATENT DOCUMENTS

| | | | |
|---|---|---|---|
| KR | 10-0490112 | B1 | 9/2002 |
| KR | 10-0499613 | B1 | 7/2005 |
| KR | 10-0515608 | B1 | 9/2005 |
| KR | 10-0531165 | B1 | 11/2005 |
| KR | 10-0575139 | B1 | 4/2006 |
| KR | 10-0691161 | B1 | 11/2006 |
| KR | 10-0695046 | B1 | 3/2007 |
| KR | 10-0724070 | B1 | 5/2007 |

(Continued)

*Primary Examiner* — Laura Edwards
(74) *Attorney, Agent, or Firm* — John K. Park; Park Law Firm

(57) ABSTRACT

The present invention relates to an apparatus which coats a substrate inside the vacuum chamber with the powder transported and entrained on the air from the outside without any extra gas supplier. Namely, the apparatus can coat the powder transported and entrained on the air naturally sucked in from the outside on a substrate through the spray nozzle inside the vacuum chamber as the pressure of the vacuum chamber is controlled and the pressure of the front of the spray nozzle is set under the atmospheric pressure.

19 Claims, 6 Drawing Sheets

(56) References Cited

FOREIGN PATENT DOCUMENTS

| | | | |
|---|---|---|---|
| KR | 10-0767395 | B1 | 10/2007 |
| KR | 10-0770173 | B1 | 10/2007 |
| KR | 10-0846148 | B1 | 7/2008 |
| KR | 10-2008-0090115 | A1 | 9/2008 |
| KR | 10-2008-0111430 | A1 | 11/2008 |
| KR | 2009-0021959 | A1 | 3/2009 |
| KR | 2009-0032151 | A1 | 4/2009 |
| KR | 10-0991723 | B1 | 10/2010 |
| KR | 10-1020042 | B1 | 2/2011 |
| KR | 10-1023672 | B1 | 3/2011 |
| KR | 10-1042554 | B1 | 6/2011 |

* cited by examiner

APPARATUS FOR POWER COATING

BACKGROUND OF THE INVENTION

1. Field of the Invention

The present invention relates to a method and an apparatus that coat the powder on a substrate placed inside the vacuum chamber continuously and uniformly by spraying the powder entrained on the carrier air which is sucked in from the outside at atmospheric pressure without any devices supplying specific gas.

2. Background Art

The conventional coatings spraying the powder on a substrate are briefly described as follows;

1. Cold Spray

Cold spray coats 1-50 μm metal particles on a substrate by spraying them with the pressurized gas that temperature of it is a few hundred° C. and pressures range from 10 to 40 bars. The spray velocity of the gas in the cold spray is more than 300 m/s. The particles are coated as being deformed plastically by the kinetic energy caused by the velocity of gas and heat of gas when they collide with a substrate. The thickness of the coating layer in the cold spray ranges from a few millimeters to a few centimeters. But the weakness of cold spray is that either fine particles or ones having low specific weight are not coated because their velocity noticeably decreases by the shock wave or the aerodynamic drag occurring shortly after the gas impinges upon the substrate.

(1) U.S. Pat. No. 5,302,414 ("Gas-dynamic spraying method for applying a coating"; PCT/SU90/00126) relates to a spray coating technique that uses 3 different ways to feed powder by the pressurized gas. The first method shown in [FIG. 1] of the patent shows that a compressed gas is transported to a pressure pipe and to a hopper containing powder and then the powder mixed with gas is transported to a nozzle by spinning a cylinder drum which is able to adjust pressure properly to prevent powder from flowing backward. The second shown in [FIG. 4] of the patent shows that a compressed gas is sent to a feeder containing powder directly and pushes away powder into a nozzle. The third shown in [FIG. 5] of the patent shows that a compressed gas is transferred to a heating unit and a feeder separately, and the heated gas and the powder are mixed in a mixing chamber which is connected to a carrier gas pipe and a powder feeding pipe, and the powder is sent to a nozzle smoothly without backflow.

(2) U.S. Pat. No. 6,139,913 ("Kinetic spray coating method and apparatus") is about a spray coating technique. As shown in [FIG. 2] of the patent, pressurized gas is transported to a premix chamber and the powder is sent to the mixing chamber under higher pressure than the carrier gas.

(3) U.S. Pat. No. 6,569,245 ("Method and apparatus for applying a powder coating") relates to an apparatus that powder under atmospheric pressure and the highly compressed carrier gas are transported to the nozzle unit and mixed in the ejection cap, and then they are sprayed on a substrate. As shown in [FIG. 1] of the patent, there is a problem that velocity of the powder can decrease after the powder hits the profile-shaping plate inside the nozzle unit and thus it cannot reach necessary coating velocity at the ejection cap. Another problem is that the powder can be coated on the profile-shaping plate, not the target substrate.

(4) U.S. Pat. No. 4,815,414 ("Powder spray apparatus") shows a coating technique that powder under atmospheric pressure is transported to a nozzle unit and coated on a substrate. As shown in [FIG. 1] of the patent, powder in a feeder and compressed air in the compressed air supplier are sent to a nozzle unit and then ejected through a nozzle for coating. In this apparatus, pressure of the nozzle unit must be lower than atmospheric pressure in order for powder under atmospheric pressure to be transported to the nozzle unit. It may give rise to powder backflow. It, therefore, becomes more difficult to transfer powder to the nozzle unit when pressure of the compressed air increases to make spraying velocity of powder faster.

(5) Korea Pat. No. 10-0770173 ("Cold spray apparatus"), Korea Pat. No. 10-0575139 ("Cold spray apparatus with gas cooling system"), and Korea Pat. No. 10-0515608 ("Cold spray apparatus with powder preheating system"; PCT/KR04/03395) relate to a method transporting and coating powder by using a nitrogen gas, a helium gas, and an air as the conventional cold spray.

(6) Korea Pat. No. 10-0691161 ("Method fabricating field emitter electrode") relates to the method fabricating the field emitter electrode with carbon nanotube powder by application of cold spray. But it also failed to overcome the problems shown from cold spray.

(7) U.S. Pat. No. 6,759,085 ("Method and apparatus for low pressure cold spraying; PCT/US03/18758; WO 03/106051) relates to the method recycling expensive pressurized inert gas which is usually used in Cold spray apparatus. The cold spray nozzle placed in the vacuum tank sprays powder transferred by the pressurized gas. And after the gas is sprayed, it is filtered through the vacuum pump and the carrier gas is compressed again by the gas compressor and recycled.

As described above, the weaknesses of the conventional cold spray are 1) needing a compressed gas supplier for the compressed air or the expensive inert gases such as nitrogen and helium to transport powder, 2) having difficulty in keeping on feeding a fixed amount of powder because it must be fed by force (injection), 3) generating a loud noise because it sprays in the air under atmospheric pressure, 4) being not able to spray on some substrates which cannot stand heat from the high temperature gas or heated powder, and 5) having difficulty in coating the powders which have a low specific gravity, much agglomeration between particles, or sub-micrometer size particles because velocity of powder noticeably decreases by the shockwave.

2. Aerosol Deposition

Aerosol Deposition developed and improved from Gas Deposition made it possible to fabricate a variety of thin layers. It is a key concept of aerosol deposition that carrier gas flows into the aerosol chamber containing powder and the powder and the gas are mixed and formed into the aerosol which is transported to the deposition chamber by the difference of pressure between the aerosol chamber and the deposition chamber and then the powder is deposited on a substrate by being blown through a nozzle in the vacuum deposition chamber.

(1) Korea Pat. No. 10-0767395 ("Composite structured material" PCT/JP2000/007076), Korea Pat. No. 10-0695046 ("Method for forming ultrafine particle brittle material at low temperature and ultrafine particle brittle material for use therein" PCT/JP2003/006640), and Korea Pat. No. 10-0724070 ("Composite structured material and method for preparation thereof and apparatus for preparation thereof" PCT/JP2000/007076) relate to the technique that applies the aerosol deposition method to coating. They show the spraying method that the pressurized gas generated by the gas compression units such as a gas compressor, a nitrogen tank, and a helium tank is transported into the aerosol chamber and mixed with the powder to make aerosol. And aerosol is transferred to the vacuum chamber through the carrier pipe and sprayed through a nozzle. Therefore, pressure of the pressurized carrier gas must be higher than one of the vacuum chamber in order for the powder to be transported to the subsonic nozzle.

However, it is very difficult to keep a fixed amount of aerosol coming out of the aerosol chamber uniformly and continuously.

(2) Korea Pat. No. 10-531165 ("Method and apparatus for carbon fiber fixed on a substrate"; U.S. Pat. No. 7,306,503 ("Method and apparatus of fixing carbon fibers on a substrate using an aerosol deposition process")) has disclosed that in addition to a basic principle of aerosol deposition, the aerosol chamber can directly generate carbon nanotubes inside it and the carbon nanotubes generated in the aerosol chamber are mixed with gas and transported to a deposition chamber to be deposited on a substrate by a nozzle. The technique was applied to form a thin layer which was expected to be as good as a thin metal layer. But it was not successful since it was not possible to make a thin layer with uniformity and low sheet resistance by the aerosol deposition technique. The shape of a carbon nanotube particle is very different from one of a metal particle. It is a tube type and has a peculiar aspect ratio of diameter (dozens of nanometers) to length (dozens of micrometers), 500~1.000 fold, which is completely different from a metal particle. And the carbon nanotube powder shows an agglomerate state by a Van der Waals force and an entangled state by a high molecule chain. These properties of the carbon nanotubes are the cause of the powder feeding problem and have been the obstacle to manufacturing commercialized large size products which absolutely need uniform coating.

Korea Pat. No. 10-0499613 ("Manufacture method for electron-emitting device, electron source, light-emitting apparatus, and image-forming apparatus") and Korea Pat. No. 10-0490112 ("Method of producing fiber, and methods of producing electron-emitting device, electron source, and image display device each using the fiber") disclose the method manufacturing devices such as an electron-emitting device using the above mentioned method.

(3) Korea Pat. No. 10-0846148 ("Deposition method using powder material and device thereby") relates to the technique applying aerosol deposition which coats a thin layer at room temperature by keeping the adequate pressure enough to accelerate the velocity of particles inside the deposition chamber. But there is a problem coating continuously and uniformly because when adjusting the pressure to get necessary pressure, velocity of powder changes which means that there is difficulty getting a uniform coating layer. The aerosol chamber has a filter or a windmill to disperse the entangled powder, but it could produce the opposite effect on dispersion and the filter could make the flow rate of carrier gas worse. It results in unsteady feeding of powder and being not able to form a uniform coating layer.

This technique tried to make the impact energy of the powder stronger as increasing the velocity of the particles of the powder being sprayed through the nozzle by opening and closing the carrier gas pipe intermittently. However, the maximum velocity of the particle at the subsonic orifice-type nozzle exit is Mach 1 at best. As pressure of the nozzle inlet increases as opening and closing the carrier gas pipe intermittently, the mass flow rate through the nozzle increases, but the velocity of the particles of the gas and the powder at the nozzle outlet does not. So Aerosol Deposition, likewise Cold Spray, also needs the compressed gas supplier for carrying the powder and has a problem getting a uniform coating layer because a concentration of powders cannot be controlled.

In conclusion, both Cold Spray and Aerosol Deposition have the following weaknesses which need to be improved. 1) They require the pressurized inert gas or the compressed air higher than atmospheric pressure to carry the powder. 2) They have a problem feeding and spraying a fixed amount of powder continuously. 3) They have difficulty in coating the powders which have a low specific gravity, highly agglomerated particles, or sub-micrometer size particles.

DETAILED DESCRIPTION OF THE INVENTION

The present invention has been made to solve the above-described problems and to disclose a method and an apparatus for fabricating a uniform coating layer. Pressure around the front of the nozzle outlet is set at pressure lower than atmospheric one by controlling pressure inside the vacuum chamber. So the present invention does not need an extra gas supplier for the pressurized inert gas or the compressed air. The powder which is smoothly fed, transported, and sprayed through the nozzle by the differences of pressures without the extra gas supplier can be coated on a substrate successfully.

As shown in from [FIG. 1] to [FIG. 11], the present invention relates to an apparatus comprising the following units; an air inlet unit (10) absorbing the air under atmospheric pressure; a feeder unit (20) uniformly supplying the fixed amount of powder to the air current sucked in through the air inlet unit; a carrier pipe (30) transporting the air mixed with the powder; a spray nozzle (40) ejecting the powder at the end of the carrier pipe (30); a vacuum chamber (50) inside which a substrate (1) and the said spray nozzle (40) are placed and to which a ventilation pump (51) is connected; a pressure controller controlling the ventilation rate of the ventilation pump (51).

Also, the present invention includes a flow rate controller (11) which is connected to the air inlet unit and controls a flow rate of the air sucked in (inflow).

The present invention includes an air temperature controller (12) which is connected to the air inlet unit and controls temperature of the air.

The present invention includes an air treatment unit (13) which is connected to the air inlet unit and filters and dries the air before it is mixed with the powder.

The present invention includes a block-type pipe (21) which is connected to both the air inlet unit (10) and the feeder unit (20) and transports the powder mixed with the air to the carrier pipe (30).

The present invention includes a branch pipe (33) which is connected to the feeder unit (20) and connects the block-type pipe (21) having an open side and the carrier pipe (30). The branch pipe (33) has a powder temperature controller (24) and the powder is transported to the carrier pipe (30) from the block-type pipe (21) through the branch pipe. In this process the powder consecutively passes through both a particle size sorting unit (25) and a powder dispersion unit (27). And the particle size sorting unit (25) is connected to the powder recycle unit (26) through the powder recycle pipe (28).

In the present invention, the powder (3) which is transferred to the spray nozzle (40) through the carrier pipe (30) consecutively passes through the particle size sorting unit (25) and the powder dispersion unit (27). And the particle size sorting unit is connected to the powder collector (26) by the powder collection pipe (28).

The present invention has a spray nozzle position controller (31) between the end of the carrier pipe (30) and the spray nozzle (40) which can set the position of the spray nozzle.

The present invention has a substrate holder (53) inside the vacuum chamber (50) which is connected to a substrate movement unit (54).

The present invention includes a powder collection unit (55) which is connected to the ventilation pump (51) and collects the residual powder in the vacuum chamber after coating.

The present invention includes a plasma activator (No Fig.) inside the vacuum chamber to activate the surface of the substrate.

The present invention includes an electrostatic generator [No Fig.] to create an electric field between the spray nozzle (40) and the substrate (1).

The electrostatic generator consists of the first high voltage source (72) and the second high voltage source (74). One electrode of the first high voltage source (72) is connected to the carrier pipe and the other to the earth (4) by wire (71). One electrode of the second voltage power supply (74) is connected to the metal ring (73) which is connected to the spray nozzle (40) by wire (71) and the other to the earth (4) by wire (71). The grounded electrodes of the first high voltage source (72) and the second high voltage source (74) are opposite to each other (polarity).

The present invention includes the system control unit (No Fig.) which controls the pressure at the front of the spray nozzle (40), one inside the vacuum chamber (50), the flow rate of the air inlet unit (10), and the powder feed rate of the feeder unit (20). A temperature/pressure gauge (5) is set in the carrier pipe (30), at the front of the spray nozzle (40), and inside the vacuum chamber (50).

Figure 1:
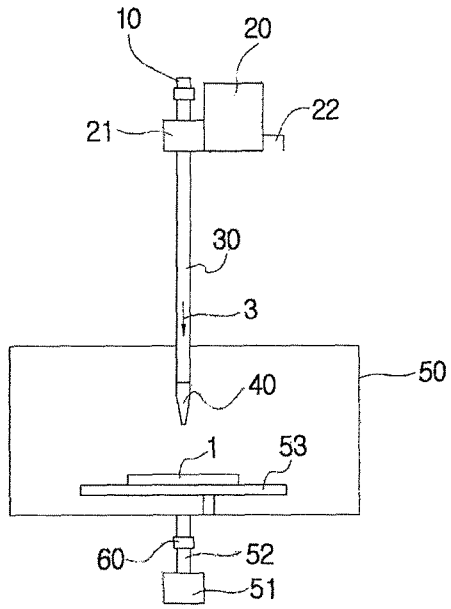
FIG. 1 is a schematic diagram explaining a basic embodiment of a continuous powder coating apparatus.

| <Names of major parts of drawings> | |
|---|---|
| 1: substrate | 2: air |
| 3: powder | 4: ground |
| 5: temperature/pressure gauge | 6: roller |
| 10: air inlet unit | 11: flow rate controller |

-continued

| <Names of major parts of drawings> | |
|---|---|
| 12: air temperature controller | 13: air treatment unit |
| 14: air filter | 15: air dryer |
| 20: feeder unit | 21: block-type pipe |
| 22: feeding controller | 23: open side |
| 24: powder temperature controller | 25: particle size sorting unit |
| 26: powder recycle unit | 27: powder dispersion unit |
| 28: powder recycle pipe | |
| 30: carrier pipe | 31: spray nozzle position controller |
| 32: mixing unit | 33: branch pipe |
| 33a: upper branch pipe | 33b: lower branch pipe |
| 40: spray nozzle | 50: vacuum chamber |
| 51: ventilation pump | 52: ventilation pump connection pipe |
| 53: substrate holder | 54: substrate movement unit |
| 55: powder collection unit | |
| 60: pressure controller | |
| 71: wire | 72: first high voltage source |
| 73: metal ring | 74: second high voltage source |
| 75: metal ring holder | |

DESCRIPTION OF THE PREFERRED EMBODIMENT

The best embodiment of the present powder coating apparatus can be obtained by the following comprising units: an air inlet unit (10) sucking in the air under atmospheric pressure without the extra gas supplier; a feeder unit (20) transporting and entraining the fixed amount of powder on the air pulled in through the air inlet unit (10); a carrier pipe (30) transporting the powder entrained on the air; a spray nozzle (40) spraying the powder which is fixed at the end of the carrier pipe (30); a vacuum chamber containing a ventilation pump (51), the spray nozzle (40), and a substrate holder (53) being able to place a substrate on it; a pressure controller (60) controlling the flow rate of the ventilation pump (50); a block-type pipe connected to the air inlet unit and the feeder unit (20) and transporting the powder entrained on the air to the carrier pipe (30); a flow rate controller (11) controlling the amount of the air being sucked in through the air inlet unit (10); an air temperature controller (12) controlling the temperature of the inflow; an air treatment unit (13) filtering and drying the air before it is mixed with the powder.

Embodiment of Powder Coating Apparatus

I. Powder Coating Apparatus

The present invention relates to the powder coating apparatus comprising an air inlet unit sucking in the air under atmospheric pressure without the extra gas supplier, a feeder unit transporting and entraining the fixed amount of powder on the air pulled in through the air inlet unit, a carrier pipe transporting the powder entrained on the air, a spray nozzle spraying the powder which is fixed at the end of the carrier pipe, a vacuum chamber which contains a substrate holder, a ventilation pump, and the spray nozzle, and a pressure controller controlling the flow rate of the ventilation pump.

The air inlet unit (10) plays the role of sucking in the air under the atmospheric pressure. The conventional methods and apparatuses for powder spray coating used the pressurized inert gases to transport the powder and therefore they needed an extra gas supplier. They used the inert gases such as argon (Ar), nitrogen ($N_2$), helium ($H_2$), and so on. These inert gases are too expensive to be used for mass production and also, there is the limitation of the volume of the gas tank. Although they replace the inert gases with the air, they need an air compressor. But the present invention can use the air flowed in through the air inlet unit (10) without any extra gas supplier. So it is suitable for the continuous process for mass production and in addition the production cost can be reduced greatly.

Figure 2:
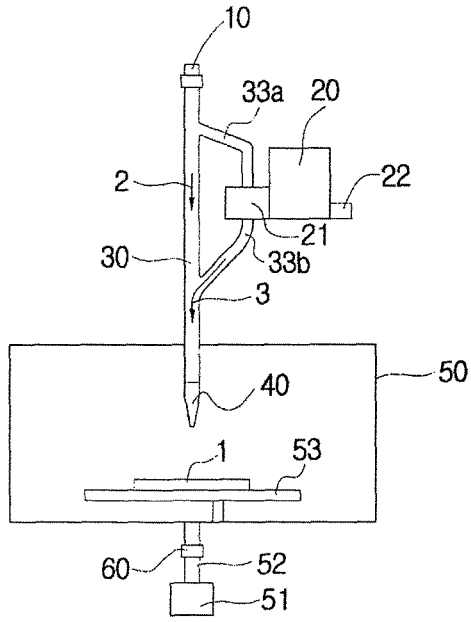
FIG. 2 is a schematic diagram explaining an embodiment of a continuous powder coating apparatus including the branch pipes.

The principle of the air suction of the air inlet unit (10), as shown in [FIG. 1] and [FIG. 2], is that as the pressure inside the vacuum chamber (50) is set lower than the atmospheric pressure (760 torr) by the pressure controller (60) connected to the ventilation pump (51), the air under the atmospheric pressure can be flowed into the air inlet unit (10) naturally. This is possible since the air inlet unit (10) is connected to the vacuum chamber (50) through the carrier pipe (30) and the spray nozzle (40).

And the flow rate of the air coming in through the air inlet unit (10) is controlled by the flow rate controller (11) which adjusts the fixed amount of the incoming air per minute. The amount of the air pulled in through the air inlet unit (10) is decided by the cross-sectional area of the spray nozzle (40) and the degree of the vacuum of the vacuum chamber (50). The optimal flow rate of the air is when chocking occurs at the nozzle throat. It is because the velocity of the air erupted from the spray nozzle becomes fastest at that moment.

The present invention forms the negative pressure inside the air inlet unit (10) by the ventilation pump (51) connected to the vacuum chamber and so the flow rate depends on the conditions of the cross-sectional area of the spray nozzle (40), the degree of the vacuum of the vacuum chamber (50), and chocking. Changing the flow rate, therefore, is possible as making the cross-sectional area of the spray nozzle (50) bigger, decreasing the air temperature at the end part of the carrier pipe, or making the pressure inside the vacuum chamber (50) lower.

These conditions are necessary for realizing the fastest spray velocity regardless of the subsonic orifice-type nozzle or the supersonic de-laval nozzle. Also, the air temperature controller (12) can be used in the air inlet unit (10) to control the temperature of the inflowing air. It is necessary not to give the thermal shock to the substrate when the powder impacts on the substrate or to keep the air temperature more than the room temperature.

The present invention includes the air treatment unit (13) filtering and drying the flowed-in air (2) before it is mixed with the powder. The air treatment unit (13) consists of an air filter (14) and an air dryer (15) for filtering and drying the air respectively. The air filter (14) is composed of a dewater filter, an oil filter, and a dust filter for removing the impurities from the air. Also, the air treatment unit (13) can be applied to [FIG. 5] to get rid of the impurities and moisture from the air pulled in through the open side (23) of the block-type pipe.

The feeder unit (20) plays the role of feeding the fixed amount of the powder into the streaming air sucked in through the air inlet unit (10). As shown in [FIG. 1] or [FIG. 3], the feeder unit (20) includes the feeding controller (22) to control the amount of the powder supplied per unit time uniformly and to let the powder mixed with the air in the block-type pipe (21). The block-type pipe (21) is connected to the air inlet unit (10) and to the feeder unit (20) and transports the powder entrained on the air to the carrier pipe (30). Either the block-type pipe (21) can be placed between the air inlet unit (10) and the carrier pipe (30) to transfer the powder to the carrier pipe directly as shown in [FIG. 1] or it can be placed between two extra branch pipes (upper branch pipe <33*a*> and lower branch pipe <33*b*>) connected to the carrier pipe to transfer and entrain the powder on the air streaming through the carrier pipe (30) as shown in [FIG. 2].

Figure 5:
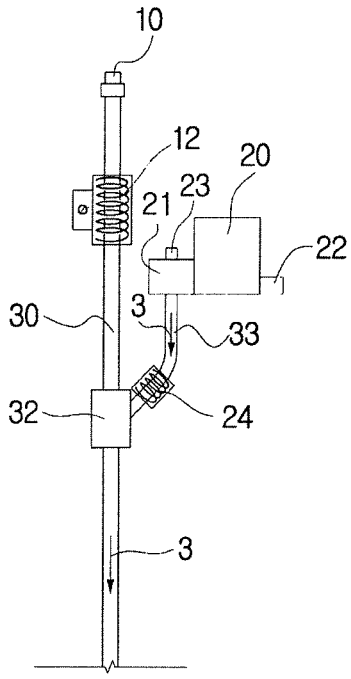
FIG. 5 is a schematic diagram explaining an embodiment of the air temperature controller and the powder temperature controller.

[FIG. 5] shows that the block-type pipe has an open side (23) sucking the outside air under the atmospheric pressure and is connected to the carrier pipe (30) through the branch pipe (33). Namely, both the air and the powder are sucked into the block-type pipe because of the negative pressure formed in the carrier pipe (30). In addition, an extra mixing unit (32) having a venture effect could be put in the middle of the carrier pipe (30) to mix the air and the powder evenly. The mixing unit (32) can be installed in the spot where the carrier pipe (30) joins the branch pipe (33) connected to the block-type pipe (21) as shown in [FIG. 5]. To transport the air and the powder smoothly, the mixing unit (32) must have appropriate shapes and cross-sectional areas as shown in [FIG. 7].

Figure 7:
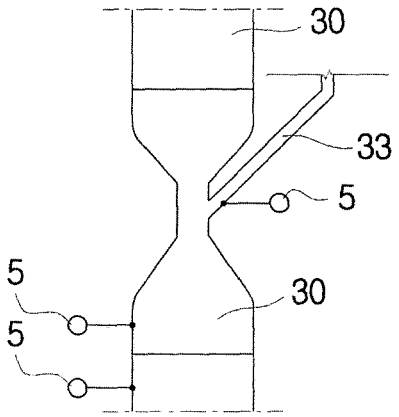
FIG. 7 is a cross-section drawing of the mixing unit applied to the present invention.

As shown in [FIG. 7], the temperature gauge and the pressure gauge are installed inside the mixing unit (32), the carrier pipe (30), and the branch pipe (33) to check and keep proper temperature and pressure (negative pressure) and to let the powder flow smoothly. (For further information about the mixing unit, see patent applications KR 10-2009-0021959 "Solid powder feeding apparatus and solid powder feeding method into pressured gas fluid pipes" and KR 10-2009-0032151 "Apparatus and method feeding powder into pressured gas fluid pipes")

The present invention also includes the powder temperature controller (24) to control the temperature of the powder. As shown in [FIG. 5], the powder temperature controller (24) is set in the branch pipe (33) connecting the block-type pipe (21) and the carrier pipe (30) and heats or cools the powder to make it be appropriate for transporting and coating.

According to the material of a substrate, the air temperature controller (12) and the powder temperature controller (24) must properly adjust the temperature of the air and of the powder so as not to give a thermal shock to the substrate by that when they impact on the substrate. A method of the temperature control not giving thermal shock on the substrate is described in Korea Pat. No. 10-2008-0111430 ("Deposition apparatus of solid powder with thermal shock control units and temperature control method for eliminating thermal shock in solid powder spray deposition").

The carrier pipe (30) transports the powder (3) entrained on the air sucked in through the air inlet unit (10) to the spray nozzle (40). It can either connect the block-type pipe of the feeder unit (20) and the spray nozzle (40) directly by itself as shown in [FIG. 1], or connect them by the branch pipes (33*a* and 33*b*) as shown in [FIG. 2]. The cross-sectional area of the carrier pipe (30) must neither increase nor decrease by the impact from the outside or by the inside pressure of the carrier pipe to keep the fixed amount and the velocity of the powder (3) streaming inside it. For instance, the carrier pipe (30) made of plastic material could be vibrated and its cross-sectional area could be changed by the impact from the outside or by the pressure inside it. At the same time, the amount and the velocity of the powder flowing through the carrier pipe (30) could become irregular. So to coat the powder on a substrate (1) uniformly, it is more desirable that the carrier pipe (30) be made of the material such as stainless steel rather than the soft plastic material and be insulated to keep the fixed temperature of the powder.

Figure 9:
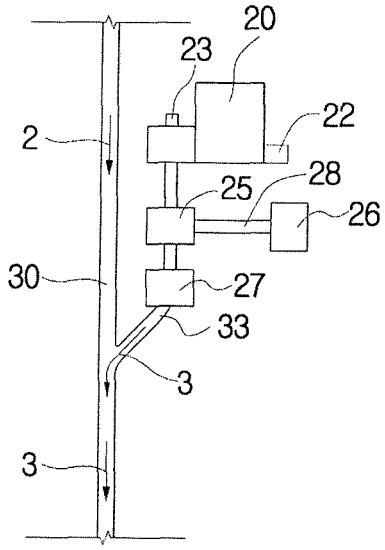
FIG. 9 is a schematic drawing explaining an embodiment of the branch pipe including a particle size sorting unit (25) and a powder dispersion unit (27).
Figure 10:
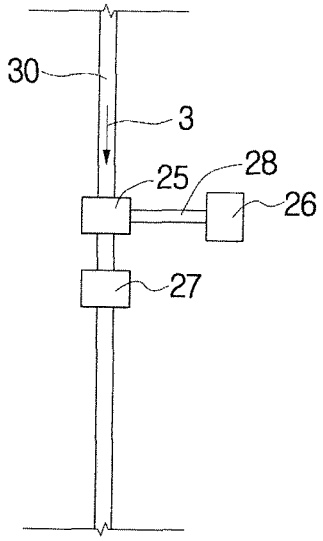
FIG. 10 is a schematic drawing explaining an embodiment of the carrier pipe including a particle size sorting unit (25) and a powder dispersion unit (27).

The components such as a particle size sorting unit (25), a powder recycle unit (26), and a powder dispersion unit (27) could be additionally installed to improve the efficiency of coating and the uniformity of the coating layer. Sorting out the same size particles and dispersing them are very important to maximize the coating efficiency at a critical velocity. [FIG. 9] and [FIG. 10] are the schematic drawings including the particle size sorting unit (25), the powder recycle unit (26), and the powder dispersion unit (27). In [FIG. 9], the feeder unit (20) is connected to the carrier pipe (30) by the branch pipe (33) and the powder goes through the block-type pipe (21), the particle size sorting unit (25), the powder dispersion unit (27), and the carrier pipe (30). The different size particles sorted out after the powder passes through the particle size sorting unit (25) are sent to the powder recycle unit (26) through the recycling pipe (28). In [FIG. 10], the powder flowing toward the spray nozzle through the carrier pipe passes through the particle size sorting unit (25) and the powder dispersion unit (27) and the different size particles are sent to the powder recycle unit (26) in the same way as shown in [FIG. 9]. But if the feeder unit (20) transfers the regular size particles, the particle size sorting unit (25) could not be necessary. The powder dispersion unit (27) makes the agglomerated powder dispersed enough to be coated on a substrate most efficiently. The degree of powder dispersion by it is decided by the feeding methods of the feeder unit (20) like a way of volume or a way of weight, the agglomeration characteristic of the powder, and a degree of the powder defect.

The spray nozzle (40) is connected to the end of the carrier pipe (30) and coats a substrate inside the vacuum chamber (50) by spraying the powder entrained on the air. The spray nozzle must keep velocity of the ejected powder more than critical velocity and less than erosion velocity to get the most coating efficiency. According to the size and the kind of the powder, a subsonic nozzle (Mach number/M<1), a sonic nozzle (Mach number/M=1), or a supersonic nozzle (Mach number/M>1) can be used as the spray nozzle. The subsonic nozzle is also known as orifice nozzle and has a shape of the cross section converging to the nozzle outlet. The fastest velocity of the gas at the outlet of the subsonic nozzle is Mach 1. But the cross-sectional shape of the supersonic nozzle converges from a nozzle inlet to a nozzle throat and diverges from a nozzle throat to a nozzle outlet and it is known as Laval nozzle. The first supersonic nozzle was invented by a Swede, Gustaf de Laval, in 1897 and it was applied to a steam turbine and then to a rocket engine by Robert Goddard later. The Mach number (M) of the supersonic nozzle is depended on the pressure, temperature, and the cross-sectional area ratio. As the critical velocity and the erosion velocity of powder are different according to its kind, size, and specific weight, a spray nozzle should be chosen considering these properties of the powder.

Figure 3:
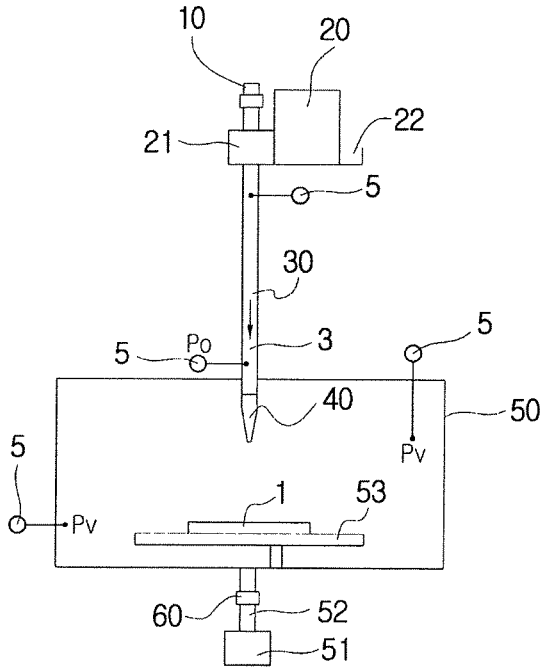
FIG. 3 is a schematic diagram showing an embodiment of the major units of the present invention including temperature/pressure gauges.
Figure 4:
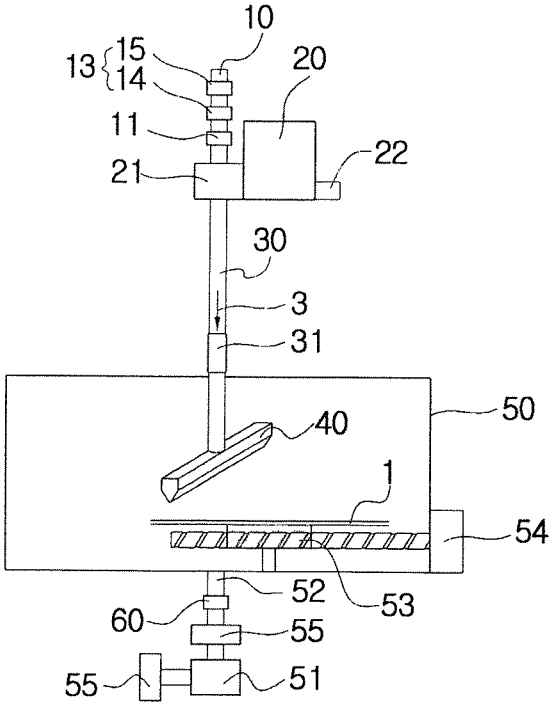
FIG. 4 is a schematic diagram showing an embodiment of the flow rate controller and the air treatment unit.
Figure 6:
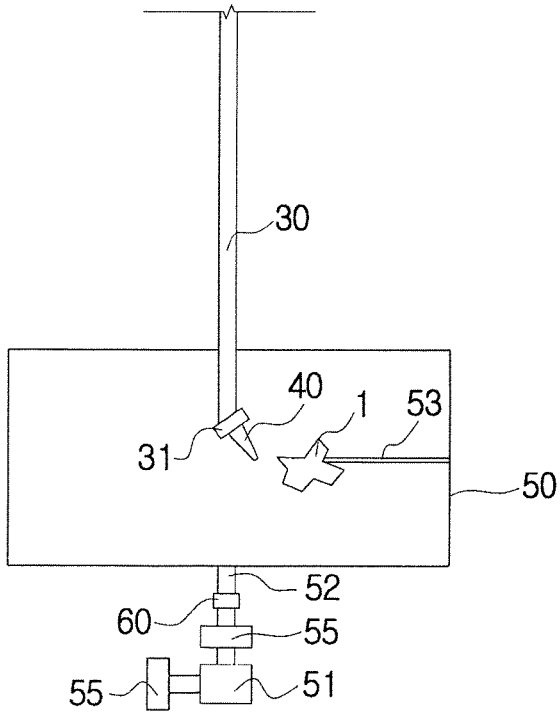
FIG. 6 is a drawing of a device using the spray nozzle position controller for coating a surface of a 3 dimensional workpiece.

The shape of the spray nozzle could be either a round spray nozzle (subsonic nozzle or supersonic nozzle) as shown in [FIG. 1] or [FIG. 3], or a slit nozzle (subsonic nozzle or supersonic nozzle) suitable for coating a large size substrate as shown in [FIG. 4] and a 3 dimensional work piece as shown in [FIG. 6]. And the spray nozzle can be made of stainless steel, titanium, and aluminum alloy which are resistant to pressure and temperature.

The position of the spray nozzle (40) can be controlled by the spray nozzle position controller (31) and it can be placed between the carrier pipe (30) and the spray nozzle (40). The spray nozzle position controller (31) can move the spray nozzle to a certain point (x, y, z) inside the vacuum chamber and adjust the distance between the substrate (1) and the spray nozzle (40). The spray nozzle position controller (31) is very useful when the spray nozzle (40) coats a 3 dimensional work piece placed in an arbitrary spot.

The vacuum chamber (50) is a space where a plane substrate or a 3 dimensional work piece can be coated by the spray nozzle (40). It contains the spray nozzle (40) and the substrate holder (53) which is connected to the substrate movement unit (54) being able to move the substrate (1). The substrate holder (53) can be placed as shown in [FIG. 1] or [FIG. 3] and be installed together with the substrate movement unit (54) as shown in [FIG. 4].

The vacuum chuck is installed under the substrate and fixes it by sucking. And so the substrate (1) can be fixed firmly even if the substrate movement unit (54) operates and it does not move when the powder (3) impacts it. The suction pressure of the vacuum chuck must be properly controlled not to make the substrate detached from the substrate holder (53) by the difference of pressure between the suction pressure and the ventilation pressure. To control the suction pressure of the vacuum chuck an extra ventilation pump can be installed or the vacuum chuck can be connected to the ventilation pump connection pipe (52) connected to the vacuum chamber (50).

Figure 8:
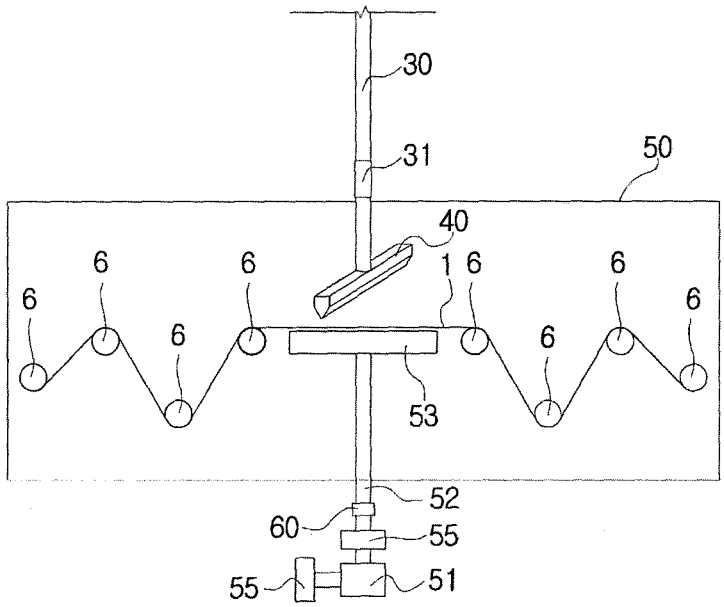
FIG. 8 is a schematic drawing explaining an embodiment of a roll-to-roll device applied to the present invention for moving the substrate.

In the present invention, the vacuum chamber (50) shows a variety of embodiments being able to coat the powder on a substrate (1) regardless of its material. The batch type substrate movement unit by which a moving substrate can be coated, could be used for coating the hard or flexible substrates. However, for the flexible substrates such as polymer film and foil, the batch type substrate movement unit can be replaced with the roll-to-roll type as shown in [FIG. 8]. Korea Pat. No. 10-2008-0090115 ("Roll-to-roll apparatus for fixing solid powder on flexible substrates") can be applied to the embodiments of the roll-to-roll type. The substrate movement unit can control the movement speed and the number of movements of the substrate and be assembled, disassembled, and replaced according to the material of the substrate.

As shown in [FIG. 4], the substrate holder (53) inside the vacuum chamber (50) can fix the 3 dimensional substrates (regular shapes like spheres, tetrahedrons, poles, and pipes and irregular ones) for coating and freely control the position of the substrate for coating the 3 dimensional work pieces.

The vacuum chamber (50) has to be made of durable materials such as stainless steel or aluminum alloy which can endure the pressure from the outside when it is vacuumed. And it needs several holes through which the inside of the vacuum chamber can be observed. And the vacuum chamber has the doors [No Fig.] for setting the substrate (1) and for cleaning the inside of it smoothly and has the ventilation pump (51) to keep on vacuuming the vacuum chamber (50). It can minimize the chemical reaction being able to occur inside the vacuum chamber and reduce the noise when spraying the powder.

The pressure controller (60) is installed between the vacuum chamber (50) and the ventilation pump (51). It controls the pressure of the vacuum chamber (50) controlling the ventilation rate of the ventilation pump (51). As it keeps the fixed pressure of the vacuum chamber, the air sucking in from the air inlet unit (10) and the powder transported by the feeder unit (20) can be mixed continuously. And also the pressure at the nozzle inlet, at the end part of the carrier pipe, and the pressure of the vacuum chamber can be efficiently controlled when spraying the powder on the substrate.

The ventilation pump (51) can include the powder collection unit (55) collecting the residual powder inside the vacuum chamber (40) after coating the substrate. As shown in [FIG. 4] and [FIG. 8], they can be installed at the front and at the back of the ventilation pump (51).

The vacuum chamber can also include the plasma surface treatment unit to improve coating efficiency. The surface of the substrate treated by plasma is strongly activated as the energy of ions or electrons increases and so the powder can be bonded to the activated surface with the stronger adhesion. In addition, as the plasma surface treatment process is eco-friendly, it is very useful in industry.

The present invention also includes the electrostatic generator to improve coating uniformity and coating efficiency. It can make the powder impact on the substrate more easily and effectively as shaping the electric field between the spray nozzle (40) and the substrate (1).

Figure 11:
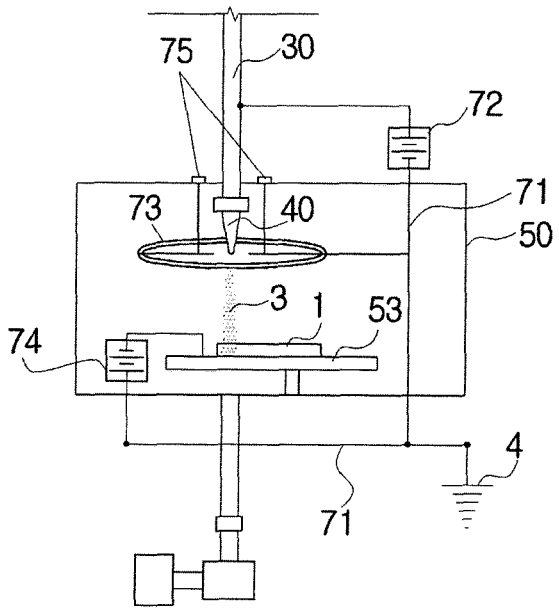
FIG. 11 is a schematic drawing explaining an embodiment of the electrostatic generator.

As shown in [FIG. 11], the electrostatic generator is composed of the first high voltage source (72), the second high voltage source (74), the metal ring (73), and the wire (71) connecting them.

One electrode of the first high voltage source (72) is connected to the carrier pipe and the other to the earth (4) by wire (71). The metal ring (73) is connected to the spray nozzle (4) by the wire and generates a strong electric field between the spray nozzle (40) and the substrate (1) when voltage is applied to the first high voltage source (72) or the second voltage power supply (74). One electrode of the second voltage power supply (74) is connected to the metal ring (73) which is connected to the spray nozzle (40) by wire (71) and the other to the earth (4) by wire (71). The grounded electrodes of the first high voltage source (72) and the second high voltage source (74) have to be opposite to each other (polarity). And the wire (71) connecting the first high voltage source (72) and the ground (4) is connected to the metal ring (73) by a branch wire. It depends on the shape, the size, and the kind of powder as well as coating efficiency whether the electrostatic generator is used.

The present invention also includes a system controller [No Fig.], an interlocking control system, which controls the pressure at the front of the spray nozzle (40), the pressure of the inside of the vacuum chamber (50), the inflowing rate at the air inlet unit (11), and the feeding rate of the feeder unit (20).

For effective operation of the system controller, as shown in [FIG. 3], it is desirable to install the temperature/pressure gauges inside the carrier pipe (30), around the front of the spray nozzle, and inside the vacuum chamber (50) and to get the data of temperature and pressure of each part.

The temperature/pressure gauges can be also installed in the mixing unit (32) and in the branch pipe (33) to send the data such as the temperature and the pressure of them to the system controller. The flow rate gauge can be installed in the flow rate controller (11) and the powder feeding gauge in the feeding controller to do the same.

The velocity of the powder (3) sprayed from the spray nozzle (40) could be subsonic or supersonic by the change of the cross-sectional area ratio between the throat and the outset of the spray nozzle or by the pressure/temperature difference between the ending part of the carrier pipe (30) and the spray nozzle outlet when the pressure (Po) at the ending part of the carrier pipe (30) shortly before the spray nozzle (40) is set under 760 torr. So the system controller controls the pressure of the vacuum chamber to let the air flow in the carrier pipe through the air inlet unit (10) and the powder transported from the feeder unit (20) is entrained on the air and then sprayed through the spray nozzle (40) at the subsonic or supersonic velocity according to the above mentioned condition. The more detailed description of this is given by the following part, "II. Powder coating method".

II. Powder Coating Method

The present invention relates to the method coating the powder on a substrate using the powder coating apparatus (hereafter, 'powder coating method'). The powder coating method is composed of the five stages: (a) stage ventilating the air from the vacuum chamber (50); (b) stage setting the pressure (Po) at the ending part of the carrier pipe (30) shortly before the spray nozzle (40) under 760 torr; (c) stage controlling the pressure inside the vacuum chamber (50) in accordance with the spraying conditions (expansion wave, normal shock wave, and oblique shock wave occurring around the nozzle outlet); (d) stage transporting the powder entrained on the air pulled in from the outside to the spray nozzle (40); (e) stage spraying the powder on a substrate inside the vacuum chamber (50) through the spray nozzle at a subsonic or supersonic velocity. The detailed explanation of each stage is as follows:

(a) stage is a process ventilating the air inside the vacuum chamber (50). The pressure of the vacuum chamber can be kept at a certain level as the air is ventilated through the ventilation pump (51) connected to the vacuum chamber. In this stage, the outside air starts to be sucked in and preparation for setting the pressure of the vacuum chamber is done.

(b) stage is a process setting the pressure (Po) at the ending part of the carrier pipe (30) shortly before the spray nozzle (40) under 760 torr and satisfying the conditions being able to transport the powder under atmospheric pressure to the carrier pipe (30) smoothly.

(c) stage is a process setting the pressure (Pv) inside the vacuum chamber (50) for the spraying conditions (expansion wave, normal shock wave, and oblique shock wave occurring around the nozzle outlet). The vacuum chamber keeps the arbitrary pressure after (a) stage. In this state, the pressure (Pv) inside the vacuum chamber (50) is decided according to both the pressure (Po) at the ending part of the carrier pipe (30) shortly before the spray nozzle (40) obtained from the (b) stage and the Mach number of the air velocity in the nozzle outlet (40). The pressure (Pv) fitting to the spraying conditions is made by the pressure controller (60) connected to the ventilation pump.

For instance, the best velocity of the air ejected from the outlet of the subsonic nozzle cannot be more than M (Mach number)=1 (sonic velocity) when the subsonic nozzle is used. The best velocity, M=1, is realized when the ratio of the pressure (Po) at the ending part of the carrier pipe to the pressure (Pe) of the outlet of the spray nozzle is 0.528. So the best velocity realized by the subsonic nozzle occurs when the pressure (Po) at the ending part of the carrier pipe (30) is set under atmospheric pressure (760 torr) and the pressure (Pb) of the subsonic nozzle outlet is set under the pressure obtained by Po×0.528.

But the Mach number of the air velocity in the supersonic nozzle outlet is decided by the pressure, the temperature, and the cross-sectional area ratio between the nozzle throat and the nozzle outlet. So the Mach number of the air velocity in the nozzle outlet is 1.5 when the powder entrained on the air flows the carrier pipe, the pressure (Po) is 700 torr, and the cross-sectional area ratio of the nozzle throat to the nozzle outlet (Ae/A*) is 1.176. At the moment, the pressure around the supersonic nozzle outlet is 190 torr and the sprayed air can completely expand without generating expansion wave or shock wave. Therefore, the best velocity (M=1.5) of the sprayed air at the supersonic nozzle outlet can be kept under the above-described conditions.

(d) stage is a process sucking the outside air and transporting the powder entrained on the air to the spray nozzle (40). Namely, the powder is transported to the spray nozzle though the carrier pipe (30) at the pressure set through the (a) and (b) stages.

The following additional processes can be performed in the (d) stage when the outside air is pulled in and the powder is entrained on the air.

1) A process filtering the impurities of the sucked in air
2) A process drying the sucked in air
3) A process controlling the flow rate of the sucked in air 4) A process controlling the temperature of the sucked in air (heating)

5) A process controlling the temperature of the powder (cooling or heating)

6) A process feeding the fixed amount of the powder

And for improving the powder coating uniformity and coating efficiency obtained at the (e) stage, the following processes can be added in the (d) stage.

1) A process sorting out the appropriate size of the particle

2) A process dispersing the powder (e) stage is a process coating the powder transported through the above four stages on a substrate inside the vacuum chamber as the powder is sprayed at the subsonic or supersonic velocity by the round or slit nozzle.

The several additional processes can also be performed in the (e) stage.

A process activating the surface of the substrate by the plasma can be added to improve the coating efficiency. Or a process forming the electrostatic field between the spray nozzle and the substrate can be performed to improve coating uniformity and coating efficiency.

Or a process collecting the residual powder after spraying the powder can be added.

All of the above-described five stages can be totally controlled by the system controller.

III. Industrial Applicability

Applications to which the powder coating apparatus can be applied are as follows:

1. Translucent or transparent conductive electrodes coated by powder (carbon nanotube, ITO (Indium Tin Oxide), etc.)
2. FED (Field Emission Display) and BLU (Backlight unit) coated by carbon nanotube powder
3. High efficiency lighting equipments coated by carbon nanotube powder
4. Solar cells coated by powder
5. Semiconductor diode coated by powder
6. Semiconductor circuit coated by powder (carbon nanotube, copper, etc.)
7. Multilayer capacitor coated by powder (copper, nickel, etc.)
8. Secondary cell electrode and fuel cell electrode coated by powder
9. Electromagnetic shielding materials coated by powder
10. Heat sink and heating element coated by carbon nanotube powder
11. High efficiency sensor coated by carbon nanotube powder
12. Flexible displayer coated by powder
13. Electrostatic disperser coated by powder
14. Flexible printed circuit board coated by powder
15. High molecular composites and ultra-light and high strength composites coated by carbon nanotube powder
16. Dielectric coated by powder
17. Magnetically conducting material coated by powder
18. Antifriction material coated by powder
19. Corrosion-resistance material coated by powder
20. Surface hardening material coated by powder

OTHER ADVANTAGES FOR INDUSTRY

The present invention can solve problems and weaknesses which the conventional spray coating methods have had.

Firstly, the conventional spray coating apparatuses used the inert gases like argon (Ar), nitrogen ($N_2$), and helium ($H_2$) and the compressed air as a carrier gas transporting the powder. But the present invention does not need an extra gas supplier because it can transport the powder to the spray nozzle to be sprayed by the air sucked in from the outside.

Secondly, the powder velocity sprayed from the subsonic or supersonic nozzle could be more than the critical velocity through the above-described five processes: a process ventilating the air inside the vacuum chamber; a process setting the pressure at the ending part of the carrier pipe shortly before the spray nozzle under 760 torr; a process setting the pressure inside the vacuum chamber for the spraying conditions (expansion wave, normal shock wave, and oblique shock wave occurring around the nozzle outlet); a process sucking the outside air and transporting the powder entrained on the air to the spray nozzle; a process coating the powder on a substrate inside the vacuum chamber through the spray nozzle. So a variety of powders shown below can be coated on the substrate. Metal powders having plastic deformation, ceramic powders having a property of fracture (oxide, nitride, boride, etc.), special material powders having intermediate property (carbon nanotube, fullerence, graphite, grapheme, etc.) and dissimilar material powder (metal+ceramic, metal/ceramic+special material, etc.), and other compounds made of the above elements. Powders of various particle sizes from nanometers to micrometers (quantum well, quantum wire, and quantum dot) and powders having low specific gravity. Powders of various shapes (tube, plate, sphere, wire, etc.)

Thirdly, the present invention does not give a thermal shock on a substrate using the air temperature controller adjusting the temperature of the air sucked in from the outside and the powder temperature controller controlling the temperature of the powder. So coating is possible regardless of the substrate's material such as metals, semimetals, ceramics, polymers, etc.

Fourthly, the pressure controller connected to the vacuum chamber can easily set the pressure conditions for subsonic or supersonic spray and remove the noise caused by the powder spray and reduce the chemical reactions.

Fifthly, the speed forming the coating layer can be easily controlled and the thickness of the coating layer can be controlled from a few nanometers to a few hundred micrometers by controlling the speed of the substrate movement unit and of the nozzle movement and by repeat count.

According to the present invention, the powder coating apparatus can manufacture the followings: electric and electronic coating products such as translucent or transparent conductive electrodes, field emitter for field emission display, field emitter for back light unit, CNT lightning equipments, solar cell, semiconductor, electromagnetic shielding materials, heat sink and heating element, sensor, flexible display electrode, antistatic agent, electrostatic disperser, flexible printed circuit board, dielectric, magnetically conducting material, super-capacitor, multilayer capacitor, secondary cell and electrode, etc.; coating products related to the machine like antifriction material, corrosion-resistance material, surface hardening material, etc.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. An apparatus for powder coating comprising:

an air inlet unit (10) sucking in the outside air without an extra gas supplier;

a feeder unit (20) entraining a fixed amount of the powder on the air sucked in through the air inlet unit (10);

a carrier pipe (30) transporting the powder entrained on the air from the air inlet unit (10) and the feeder unit (20);

a spray nozzle (40) connected to the end of the carrier pipe (30) and spraying the powder;

a vacuum chamber (50) including the spray nozzle (40) and connected to a ventilation pump (51); and a pressure controller (60) controlling the ventilation rate of the ventilation pump (51), wherein the spray nozzle (40) sprays the powder on a substrate (1) placed inside the vacuum chamber (50).

2. An apparatus for powder coating according to claim 1 wherein a flow rate controller (11) installed in the air inlet unit (10) controls the amount of the air incoming from the outside.

3. An apparatus for powder coating according to claim 1 wherein an air temperature controller (12) installed in the air inlet unit (10) controls the temperature of the air incoming from the outside.

4. An apparatus for powder coating according to claim 1 wherein an air treatment unit (13) filters and dries the air before it is mixed with the powder.

5. An apparatus for powder coating according to claim 1 wherein a block-type pipe (21) connected to both the air inlet unit (10) and the feeder unit (20) transports the powder entrained on the air to the carrier pipe (30).

6. An apparatus for powder coating comprising:

an air inlet unit (10) sucking in the outside air without an extra gas supplier;

a feeder unit (20) entraining a fixed amount of the powder on the air sucked in through the air inlet unit (10);

a carrier pipe (30) transporting the powder entrained on the air;

a spray nozzle (40) connected to the end of the carrier pipe and spraying the powder;

a vacuum chamber (50) including the spray nozzle and connected to a ventilation pump (51); and a pressure controller (60) controlling the ventilation rate of the ventilation pump (51), wherein the spray nozzle (40) sprays the powder on a substrate (1) placed inside the vacuum chamber (50), wherein a branch pipe (33) connected to the feeder unit (20) connects the carrier pipe (30) and a block-type pipe (21) having an open side (23).

7. An apparatus for powder coating according to claim 6 wherein a powder temperature controller (24) is installed.

8. An apparatus for powder coating according to claim 6 wherein the powder passes through a particle size sorting unit (25) and a powder dispersion unit (27) while it is transported from the block-type pipe (21) to the carrier pipe (30) through the branch pipe (31), and the particle size sorting unit (25) is connected to a powder recycle unit (26) by a powder recycle pipe (28).

9. An apparatus for powder coating comprising:

an air inlet unit (10) sucking in the outside air without an extra gas supplier;

a feeder unit (20) entraining a fixed amount of the powder on the air sucked in through the air inlet unit (10);

a carrier pipe (30) transporting the powder entrained on the air;

a spray nozzle (40) connected to the end of the carrier pipe and spraying the powder;

a vacuum chamber (50) including the spray nozzle and connected to a ventilation pump (51); and a pressure controller (60) controlling the ventilation rate of the ventilation pump (51), wherein the spray nozzle (40) sprays the powder on a substrate (1) placed inside the vacuum chamber (50), wherein the powder transported to the spray nozzle (40) through the carrier pipe (30) goes through a particle size sorting unit (25) and a powder dispersion unit (27), and the particle size sorting unit (25) is connected to a powder recycle unit (26) by a powder recycle pipe (28).

10. An apparatus for powder coating according to claim 1 wherein a spray nozzle position controller (31) adjusting the position of the spray nozzle (40) is installed between the spray nozzle (40) and the end part of the carrier pipe (30).

11. An apparatus for powder coating according to claim 1 wherein a substrate holder (53) is installed inside the vacuum chamber (50).

12. An apparatus for powder coating according to claim 11 wherein a substrate movement unit (54) connected to the substrate holder (53) is installed inside the vacuum chamber (50).

13. An apparatus for powder coating according to claim 1 wherein a powder collection unit (55) connected to the ventilation pump (51) collects the residual powder inside the vacuum chamber (50).

14. An apparatus for powder coating comprising:

an air inlet unit (10) sucking in the outside air without an extra gas supplier;

a feeder unit (20) entraining a fixed amount of the powder on the air sucked in through the air inlet unit (10);

a carrier pipe (30) transporting the powder entrained on the air;

a spray nozzle (40) connected to the end of the carrier pipe and spraying the powder;

a vacuum chamber (50) including the spray nozzle and connected to a ventilation pump (51); and a pressure controller (60) controlling the ventilation rate of the ventilation pump (51), wherein the spray nozzle (40) sprays the powder on a substrate (1) placed inside the vacuum chamber (50), wherein a plasma activator inside the vacuum chamber (50) activates the surface of the substrate.

15. An apparatus for powder coating comprising:

an air inlet unit (10) sucking in the outside air without an extra gas supplier;

a feeder unit (20) entraining a fixed amount of the powder on the air sucked in through the air inlet unit (10);

a carrier pipe (30) transporting the powder entrained on the air;

a spray nozzle (40) connected to the end of the carrier pipe and spraying the powder;

a vacuum chamber (50) including the spray nozzle and connected to a ventilation pump (51); and a pressure controller (60) controlling the ventilation rate of the ventilation pump (51), wherein the spray nozzle (40) sprays the powder on a substrate (1) placed inside the vacuum chamber (50), wherein an electrostatic generator creates an electric field between the spray nozzle (40) and the substrate (1).

16. An apparatus for powder coating according to claim 15 wherein the electrostatic generator consists of the first high voltage source (72) and the second high voltage source (74), and one electrode of the first high voltage source (72) is connected to the carrier pipe and the other to the earth (4) by wire (71), and one electrode of the second voltage power supply (74) is connected to the metal ring (73) which is connected to the spray nozzle (40) by wire (71) and the other to the earth (4) by wire (71), and the grounded electrodes of the first high voltage source (72) and the second high voltage source (74) are opposite to each other (polarity), and the wire (71) connecting the first high voltage source (72) and the ground (4) is connected to the metal ring (73) by a branch wire.

17. An apparatus for powder coating according to claim 16 wherein a system controller controls the pressure at the front of the spray nozzle (40), the pressure of the inside of the vacuum chamber (50), the inflowing rate at the air inlet unit (11), and the feeding rate of the feeder unit (20).

18. An apparatus for powder coating according to claim 17 wherein a temperature/pressure gauge (5) is installed in the carrier pipe (30), around the front of the spray nozzle (40), and inside the vacuum chamber (50).

19. An apparatus for powder coating according to claim 1 wherein the velocity of the powder (3) sprayed from the spray nozzle (40) is either subsonic or supersonic by the change of the cross-sectional area ratio between a throat and an outset of the spray nozzle or by the pressure/temperature difference between the ending part of the carrier pipe (30) and the spray nozzle outlet when the pressure (Po) at the ending part of the carrier pipe (30) shortly before a spray nozzle (40) is set under 760 torr.

* * * * *

UNITED STATES PATENT AND TRADEMARK OFFICE

CERTIFICATE OF CORRECTION

PATENT NO. : 9,079,209 B2
APPLICATION NO. : 13/878163
DATED : July 14, 2015
INVENTOR(S) : Ok Ryul Kim et al.

It is certified that error appears in the above-identified patent and that said Letters Patent is hereby corrected as shown below:

Title Page, Item (54) and in the Specification, Column 1, Line 1
The Title of Invention is:
"APPARATUS FOR POWDER COATING"

Signed and Sealed this
Twenty-fourth Day of November, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,079,209 B2
APPLICATION NO. : 13/878163
DATED : July 14, 2015
INVENTOR(S) : Ok Ryul Kim et al.

It is certified that error appears in the above-identified patent and that said Letters Patent is hereby corrected as shown below:

Title page

Inventors: Delete "(76)" and insert -- (75) --.

Insert -- (73) Assignee: To read
Femvix Corp.;
Ok Ryul Kim; and
Ok Min Kim --.

Signed and Sealed this
Twenty-sixth Day of April, 2016

Michelle K. Lee

Michelle K. Lee
*Director of the United States Patent and Trademark Office*